US005214346A

United States Patent [19]

Komatsu

[11] Patent Number: 5,214,346

[45] Date of Patent: May 25, 1993

[54] MICROELECTRONIC VACUUM FIELD EMISSION DEVICE

[75] Inventor: Hiroshi Komatsu, Suwa, Japan

[73] Assignee: Seiko Epson Corporation, Tokyo, Japan

[21] Appl. No.: 832,198

[22] Filed: Feb. 6, 1992

Related U.S. Application Data

[62] Division of Ser. No. 659,218, Feb. 21, 1991, Pat. No. 5,192,240.

[30] Foreign Application Priority Data

| | | | |
|---|---|---|---|
| Feb. 22, 1990 | [JP] | Japan | 41948 |
| Apr. 11, 1990 | [JP] | Japan | 96004 |
| Feb. 5, 1991 | [JP] | Japan | 14398 |

[51] Int. Cl.[5] ..... H01J 1/30

[52] U.S. Cl. ..... 313/309; 313/351

[58] Field of Search ..... 313/309, 336, 351

[56] References Cited

U.S. PATENT DOCUMENTS

| | | | |
|---|---|---|---|
| 4,168,213 | 9/1979 | Hoeberechts | 204/15 |
| 4,578,614 | 3/1986 | Gray et al. | 313/309 |
| 4,827,177 | 5/1989 | Lee et al. | 313/336 X |
| 4,855,636 | 8/1989 | Busta et al. | 313/306 |
| 4,904,895 | 2/1990 | Tsukamato et al. | 313/336 |

FOREIGN PATENT DOCUMENTS

| | | |
|---|---|---|
| 260075 | 3/1988 | European Pat. Off. . |
| 406886 | 1/1991 | European Pat. Off. . |

OTHER PUBLICATIONS

Journal of Applied Physics, "Physical properties of thin-film field emission cathodes with molybdenum cones", C. A. Spindt, et al. vol. 47, No. 12, Dec. 1976 pp. 5248-5263.

Electronic Engineering Collective Research Institute Report, "Fabrication of Micron-size Vacuum Triodes with Si Field Emitters", J. Itoh vol. 53, No. 10, Jun. 5, 1989 pp. 1171-1182.

*Primary Examiner*—Sandra L. O'Shea

*Attorney, Agent, or Firm*—W. Douglas Carothers, Jr.; Raymond J. Werner

[57] ABSTRACT

According to an embodiment of the present invention, a planar microelectronic vacuum triode comprises a cathode with three tips for electron emission that have been sharpened to points better than 1000 Å by a microfabrication process of over-etching (excess etching) the cathode electrode layer. The cathode tips and, alternatively, an anode electrode too are elevated above the surface of a substrate such that a straight-line path exists for electrons to flow from the cathode tips to the anode. A self-aligned fabrication process is used to advantage to have the edge of a gate electrode that is nearest to the cathode and its tips complement the adjacent edge of the cathode electrode. The combination results in very low threshold voltages needed to initiate the electron flow and a high yield of anode current compared to cathode current. The addition of a shield electrode to the triode produces a tetrode device that exhibits a very high anode resistance.

15 Claims, 11 Drawing Sheets

MICROELECTRONIC VACUUM FIELD EMISSION DEVICE

This is a division of application Ser. No. 07/659,218 filed on Feb. 21, 1991, now U.S. Pat. No. 5,192,240.

BACKGROUND OF THE INVENTION

This invention relates generally to vacuum microelectronics and more specifically to microelectronic vacuum triodes and other devices that use lateral field electron emission cathode electrodes with side projections more or less parallel to the surface of a substrate.

PRIOR ART

Arrays of microscopic-sized cones for use as field emission cathodes were developed by Spindt and his co-workers at SRI about 1973. (See, C. A. Spindt, et al., "Physical properties of thin-film field emission cathodes with molybdenum cones," Journal of Applied Physics, vol. 47, no. 12, Dec. 1976, pp. 5248–5263.) Since then silicon thin-film technology has advanced and now allows for the cathodes to be made in arrays of up to 5000 cathodes at packing densities up to $6.4\times10^5/cm^2$. These cathodes offer very low operating voltages (100–300 V), compared to 1 KV to 30 KV for conventional etched wire emitters. The low-voltage operation is achieved by placing the accelerating electrode close to the tip and making the radii of the tip very small. The low voltage allows the cathodes to operate continuously with very stable emission properties and exhibit long life. TFFECs consist basically of a conductor/insulator/conductor sandwich.

A lateral-type field electron emission device is described by Junji Ito in Oyo Butsuri (Journal of Applied Physics, Japan), Volume 59, No. 2, pp. 164–169 (1990), and is represented by FIG. 1. It has a more-or-less flat triode element comprising a multiplie tip emitter electrode 102, a gate electrode 103, and an anode electrode 104, all of which are next to one another on the surface of a quartz substrate 101. The three electrodes are each formed by photo-etching a tungsten film that is initially deposited to a thickness of about one micrometer. Emitter electrode 102 is located about fifteen micrometers from gate electrode 103 and has as many as 170 points, or tips, repeated at a ten micrometer pitch. Each tip is intended to emit an electron beam though a vacuum to anode electrode 104. Gate electrode 103 is separated from anode electrode 104 by about ten micrometers. When the planar triode of FIG. 1 is operated in a vacuum of $5\times10^{-6}$ atmospheres, at a gate voltage of 220 V and an anode voltage of 318 V, an anode current of about two microamps results. Such emission is based, in part, on a Fowler-Nordheim (F-N) tunnel current. At two microamps anode current, each emitter electrode contributes about seven nanoamps. The transconductance is approximately 0.1 microsiemens.

Electrons emitted from the tips of emitter electrode 102 will often collide with parts of gate electrode 103 on the electrons' way to anode electrode 104, because emitter electrode 102, gate electrode 103 and anode electrode 104 are all metal films deposited on the same surface plane. Such collisions are increased in their frequency by a positive voltage (with respect to emitter electrode 102) that must be placed on gate electrode 103 to get the device to function. As a result, the number of electrons getting to anode electrode 104 is reduced, and this lowers both the efficiency and transconductance measures. It is not uncommon, in the prior art, for the anode current to be as little as 60% of the emitter current. Emitter electrode 102 and gate electrode 103 are usually fabricated during the same photo-etching step. The minimum distance between electrodes 102 and 103 is limited by the resolution limits of photo-etching, a practical limit being 0.8 micrometers (or 8000 Å). Any inconsistency in structural definitions becomes harder to control as structures get smaller and their geometries diminish. Prior art planar triode makers have difficulty in reducing the voltages needed to initiate a current flow (the "threshold voltage"), because the smaller interelectrode gaps needed to do that will overstep the limits of photo-etching processes so much that the resulting inconsistencies create wide deviations in the characteristics of the triodes thus produced within a single device and amongst devices made in a manufacturing run. The radii of curvature of the projecting tips of emitter electrode 102 also has a great effect on the threshold voltage of a microelectronic vacuum device. The smaller is the radii of curvature, the lower will be the threshold voltage. The prior art manufacturing methods (e.g., photo-resist etching) caused this radii of curvature to be limited in practice to about 2,000 Å. Ideally, the radii of curvature should be, at most, 1000 Å for any reasonable threshold voltages, but this has not been possible with the prior art.

Therefore, an object of the present invention is to construct a device that reduces threshold voltages by shortening the distance between the emitter and gate electrodes and reduces the radii of curvature of the cathode tips smaller, while at the same time yielding uniform device characteristics. Another object is to provide a method of manufacturing such an improved device.

SUMMARY OF THE INVENTION

According to an embodiment of the present invention, a planar microelectronic vacuum triode comprises (a) a planar insulating substrate having at least a portion of one surface maintained in a vacuum during operation of the triode, (b) an anode electrode deposited on a first part of said surface, (c) a gate electrode deposited on a second part of said surface and proximate to the anode electrode, the gate electrode able to control a flow of electrons in the vacuum to the anode electrode, (d) a dielectric deposited on a third part of said surface and overlapping a part of the gate electrode, and (e) a cathode deposited on the surface of the dielectric such that at least one cathode tip cantilevers out beyond the dielectric and overlooks the gate electrode, at least one such tip having a sharpened end such that an electron emission is promoted thereby that can pass directly over the gate electrode and on to the anode electrode. The gate and cathode electrodes have adjacent edges whose shapes complement one another in a highly accurate and repeatable way, due in part to being able to use the cathode electrode and tips as a mask to form the gate electrode in a self-aligning process.

In an alternative embodiment, a planar microelectronic vacuum triode comprises (a) an insulating substrate with at least a portion of one of its surfaces maintained in a vacuum during operation of the triode, (b) a first dielectric deposited on a first part of said substrate surface, (c) an anode electrode deposited on the surface of the first dielectric such that the anode electrode is elevated from the substrate, (d) a depression in said substrate surface, the depression having a floor and at least one incline, (e) a gate electrode deposited on a part of said floor and an incline in the depression, the gate electrode able to control a flow of electrons through said vacuum to the anode electrode, (f) a second dielectric deposited on a second part of said substrate surface such that the depression is between the first and second parts of said substrate surface, and (g) a cathode electrode deposited on the surface of the second dielectric such that the cathode electrode is elevated from the substrate so that the flow of electrons from the cathode tips can pass directly over the gate electrode and on to the anode electrode. The cathode electrode is such that at least one cathode tip cantilevers out beyond the second dielectric and overlooks the gate electrode. The tips have such sharp ends that electron emission is promoted. As before, the gate and cathode electrodes have adjacent edges whose shapes complement one another in a highly accurate and repeatable way, due in part to being able to use the cathode electrode and tips as a mask to form the gate electrode in a self-aligning process.

An advantage of the present invention is that the distances between cathode and gate electrodes ($L_{gk}$) is principally determined by the film thickness of the insulation or gate electrode layers. Since present LSI technology can control the thicknesses of such layers very precisely, a practical method of manufacturing planar microelectronic vacuum devices having very low threshold voltages and good uniformity has been realized. In particular, while prior art technology was limited to an $L_{gk}$ of 0.8 micrometers (8000 Å), the present invention makes it possible to make it even less than 0.1 micrometers (1000 Å).

Another advantage of the present invention is that by using the present excess etching method, the radii of curvature of the emission tips on the cathode electrodes can be made much sharper, again making it possible to substantially reduce threshold voltages. The prior art has been limited to a radii of curvature of 2,000 Å, the present invention makes it practical to go below 500 Å.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 2(A) is a elevational view of the microelectronic vacuum device and FIG. 2(B) is a cross-section view along line 2B—2B in 2(A).

FIG. 6(A) is a elevational view of the device, and FIG. 6(B) is a cross-sectional view taken along line 6B—6B in FIG. 6(A).

FIG. 9(A) is a elevational view of the device, and FIG. 9(B) is a cross-sectional view taken along line 9B—9B in FIG. 9(A).

FIG. 12(A) is a elevational view of the device, and FIG. 12(B) is a cross-section view taken along line 12B—12B shown in FIG. 12(A).

FIG. 13(A) is an elevational view, and FIG. 13(B) is a cross-sectional view taken along line 13B—13B in FIG. 13(A).

DESCRIPTION OF THE PREFERRED EMBODIMENTS

First embodiment

Figure 1:
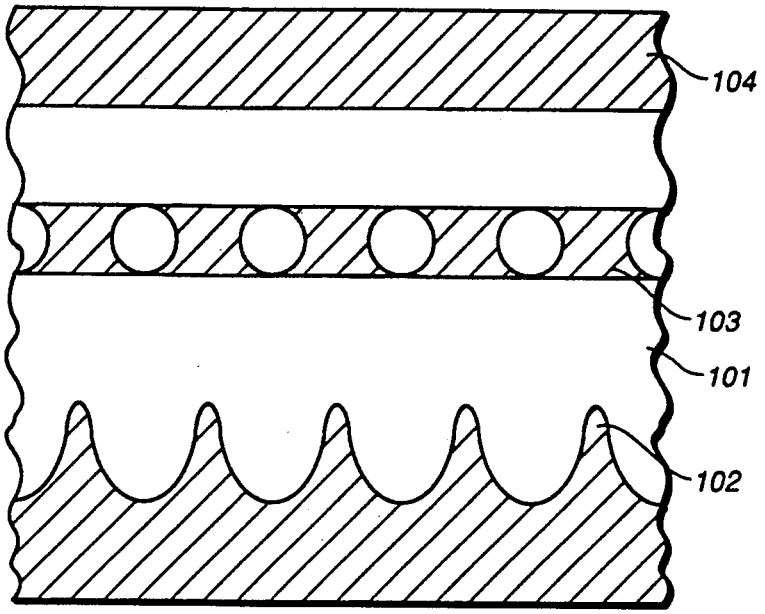
FIG. 1 (PRIOR ART)
FIG. 1 is an elevational view of prior art planar microelectronic vacuum device.
Figure 2A:
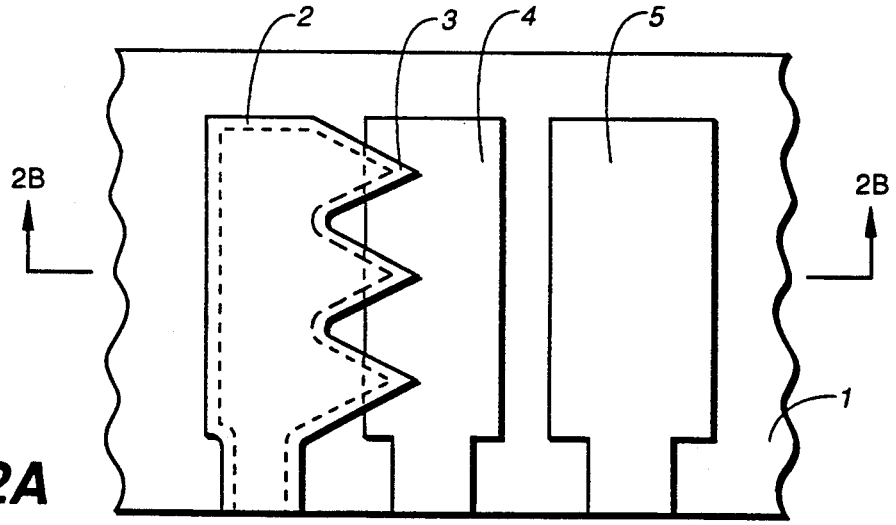
FIGS. 2(A)-(B) diagram a planar microelectronic vacuum device wherein the gate and cathode electrodes partially overlap and sandwiches an insulating layer between them.
Figure 2B:
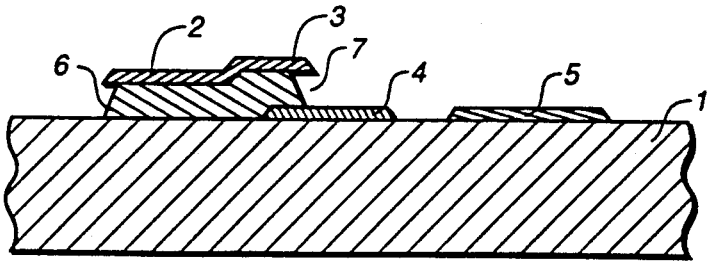

FIG. 2 is a planar microelectronic vacuum device comprising a quartz substrate 1, a cathode electrode 2 with cathode tips 3 for electron emission, a gate electrode 4, and an anode electrode 5. Electrodes 4 and 5 are made of a thin-film of molybdenum (Mo), about 2,000 Å thick, and are deposited on the surface of the quartz substrate 1. An insulation layer 6, resembling an island, comprises a thin-film of silicon dioxide ($SiO_2$) deposited about 5,000 Å thick mostly on substrate 1 with some also depositing on a part of the surface of gate electrode 4. Cathode electrode 2 comprises a thin-film of molybdenum (Mo) about 2,000 Å thick. It caps insulation layers 6 and cantilevers out beyond the edges of the island of insulation. Cathode tips 3 have a 20 micrometer pitch and are pointed in the general direction of gate electrode 4 and are more-or-less parallel to the surface plane of substrate 1. The radii of curvature of each of cathode tips 3 is uniform at about 800 Å. In general, a radii of less than 1000 Å is preferred. Cathode tips 3 cantilever out over gate electrode 4 by a separation distance $L_{gk}$ of 5,000 Å, which is principally determined by the thickness of insulation layer 6. A distance $L_{ag}$ from gate electrode 4 to anode electrode 5 is about five micrometers (50,000 Å), and a distance $L_{ak}$ from cathode tips 3 to anode electrode 5 is about twelve micrometers (120,000 Å). (Note that in this, and in the other cross-sectional figures, the vertical has been exaggerated to better show the structure being described.) It should be noted here that since cathode tips 3 are elevated above gate electrode 4, any electrons emitted from cathode tips 3 have a better chance of arriving at anode electrode 5 due to a reduced chance of them being intercepted by gate electrode 4. But although gate electrode 4 is not in the straight-line path between cathode and anode electrodes 2 and 5, gate electrode 4 will nevertheless have a current flow from cathode electrode 2 because the positive voltage of gate electrode 4 ($V_{gk}$) will attract some electrons to it. (And, the higher is the voltage $V_{gk}$, the higher will be the magnitude of the undesirable current $I_g$).

Figure 3A:
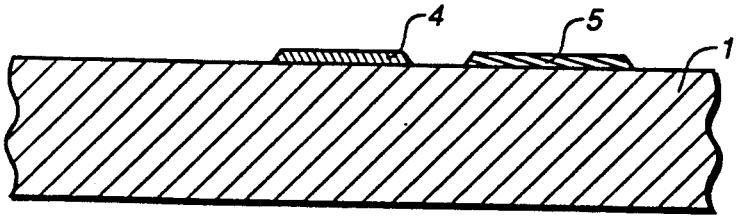
FIGS. 3(A)-(E) show cross-sectional views after each step of a first embodiment of a manufacturing process of the present invention.
Figure 3B:
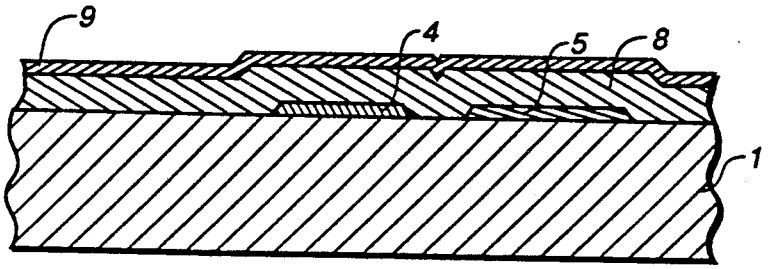
Figure 3C:
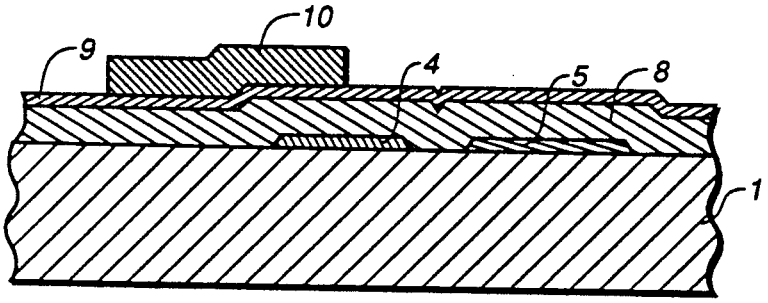
Figure 3D:
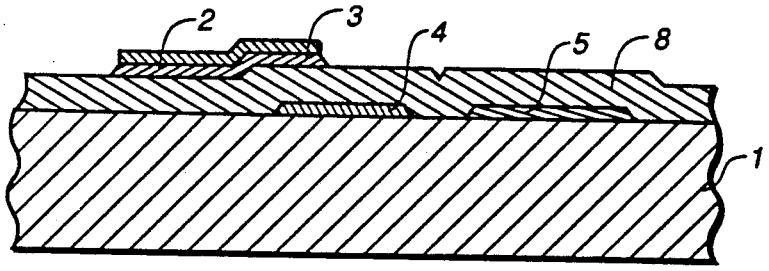
Figure 3E:
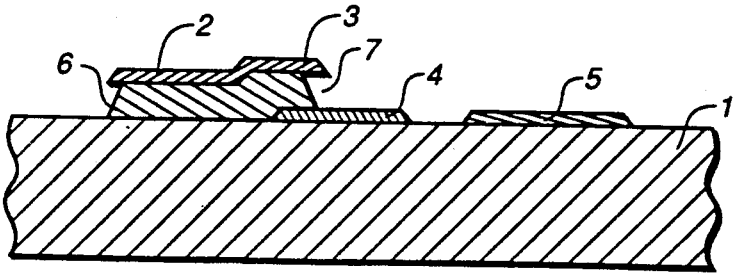
Figure 4A:
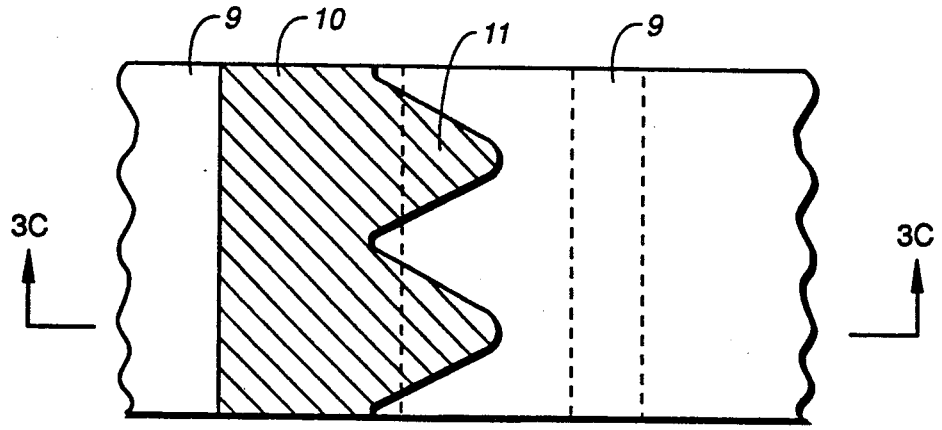
FIGS. 4(A)-(C) respectively show elevational views of the process of FIGS. 3(A)-(E) and correspond in particular to FIGS. 3(C)-(E).
Figure 4B:
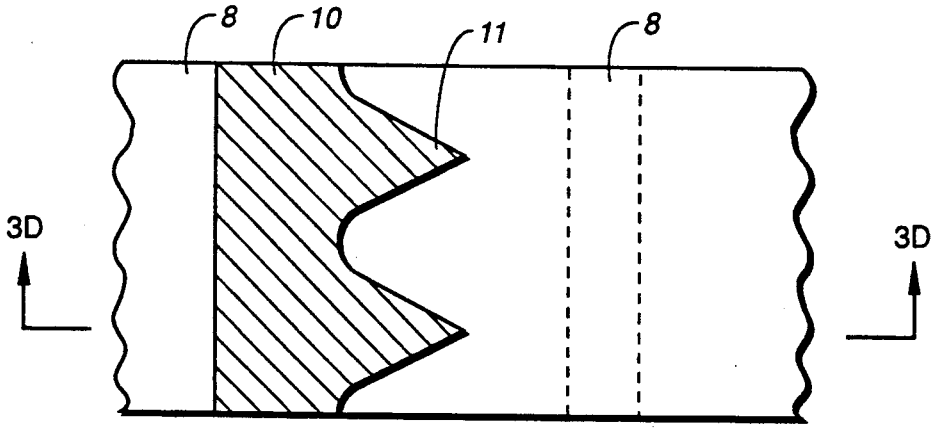
Figure 4C:
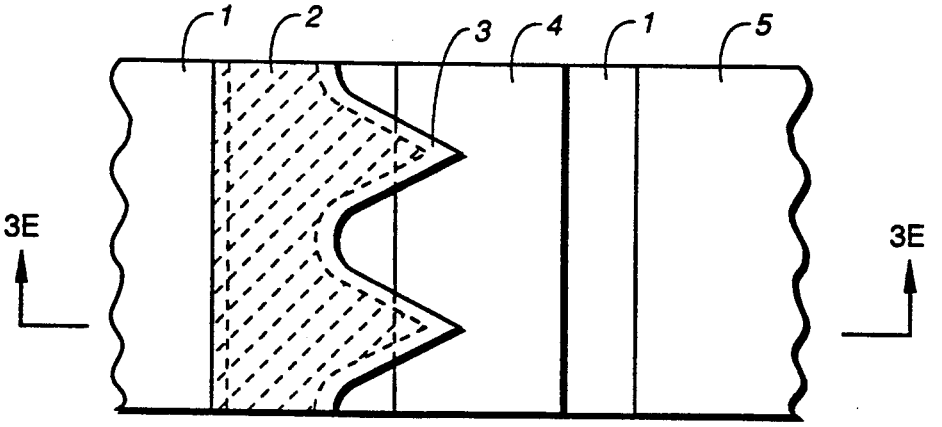

FIGS. 3(A)–(E) show several cross-sectional views, each of which corresponds to the completion of various steps in a first manufacturing processes. FIGS. 4(A)–(C) correspond to FIGS. 3(C)–(E) and provide top elevational views to help clarify the explanation below. Substrate 1 comprises a transparent quartz wafer about one millimeter thick and three inches in diameter. FIG. 3(A) shows that after sputtering a thin-film of molybdenum (Mo) about 2,000 Å thick on the surface of planar substrate 1, the film is processed to tapered shapes using a $CF_4/O_2$ plasma dry etching method with a photo-resist mask, to form gate electrode 4 and anode electrode 5. In FIG. 3(B), at first an insulation layer 8 and then a cathode-electrode layer 9 have been deposited. Insulation layer 8 is a silicon dioxide ($SiO_2$) thin-film about 5,000 Å thick, and cathode-electrode layer 9 is a molybdenum (Mo) thin-film that is about 2,000 Å thick. Both films are deposited by sputtering. Film layer 8 preferably has a bulk resistance of over 6 MV/cm. The uniformity of the film thickness should be within 2% over the surface of substrate 1. FIGS. 3(C) and 4(A) show photo-resist 10 after its initially being deposited on film 9. Photo-resist 10 is deposited about 10,000 Å thick and is used to define cathode electrode 2 from cathode-electrode layer 9. A dry etching method removes those parts of cathode-electrode layer 9 not protected by photo-resist 10, as is shown afterwards in FIGS. 3(D) and 4(B). Note how lateral etching has cut into the sides of photo-mask projections 11 and made them much more pointed (compared to FIG. 4(A)). The above dry etching process comprises using a gas mixture of $CF_4/O_2$ in a ratio of 60/200, a RF power of 700 W, and an etching time of about twenty minutes. Under these conditions, the etching speed, e.g., through film 9 will be approximately 500 Å per minute. About four minutes of etching would apparently be enough to remove all of a 2,000 Å thick layer. However, by etching for as much as twenty minutes, or five times as long as otherwise seems necessary, some lateral etching will be allowed to cut photo-mask projections 11 and cathode electrode 2 in such a way that cathode tips 3 become sharply pointed. This over-etching technique is exemplary of those referred to below as an "excess etching method." Photo-resist 10 and layers 8 and 9 each have about 8,000 Å of their thickness removed by etching in both the lateral and thickness directions. (Layer 9 has to be removed first before etching can begin to eat away layer 8.) Cathode electrode 2 comprises the gradually tapered sections that will remain beneath photo-resist 10. FIG. 3(E) shows the device after using a hydrogen fluoride (HF) etching solution to etch-off almost all of insulation layer 8, and after using a solution to peel-off the remainder of photo-resist 10. Only the part of insulating layer 8 (an island now labeled 6) that was protected under the masking effect cathode electrode 2 will remain.

FIG. 4(A) is a elevational view after fabricating photo-resist 10. Photo-resist projections 11 used in fabricating cathode tips 3 have tip radii of curvature of about 2,000 Å. FIG. 4(B) is a elevational view after fabrication of cathode electrode 2. Peripheral portions of photo-resist 10 are removed by etching about 8,000 Å by an excess etching method, and the position of photo-resist photo-mask projection 11 is set back about one micrometer. Cathode-electrode layer 9 is also etched off to leave nearly the same shape. FIG. 4(C) is a elevational view of a completed device. The tips of cathode tips 3, when viewed with a scanning electron microscope, had tip angles of about 70 degrees and a radii of curvature of about 800 Å. Also, their sections were gradually tapered in form with tip angles of about 45° and a radii of curvature of about 300 Å. As a result, it has been confirmed, empirically, by the present inventor, that cathode tips 3 are sharper than that which is practical using a photo-resist method only.

Figure 5:
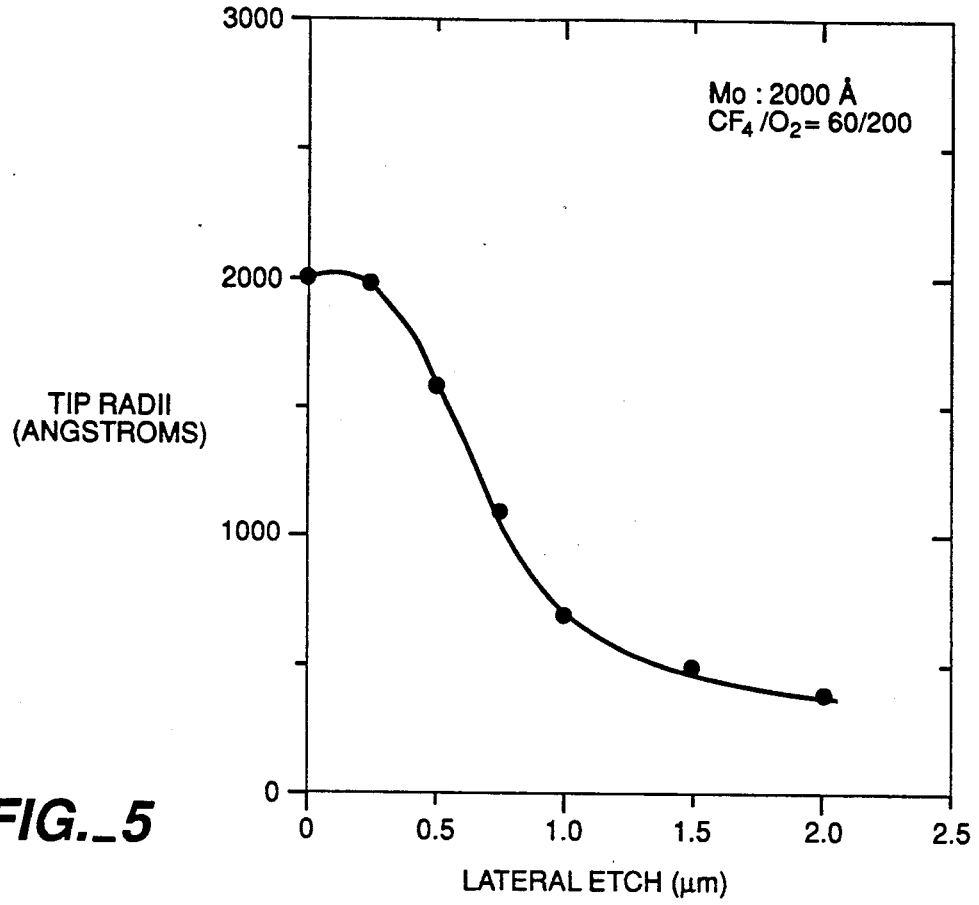
FIG. 5 shows the radii of curvature of the emission projections that result from a given amount of lateral etching (e.g., for a thin molybdenum film).

FIG. 5 is a graph showing changes in the radii of curvature of the cathode tips relative to the amount of lateral direction etching of molybdenum film. The etching conditions are the same as described above, the amount of etching can be precisely controlled by simply varying the amount of etching time. The graph of FIG. 5 shows that the radii of curvature of the tips should be less than 500 Å by excess etching five micrometers.

Figure 6A:
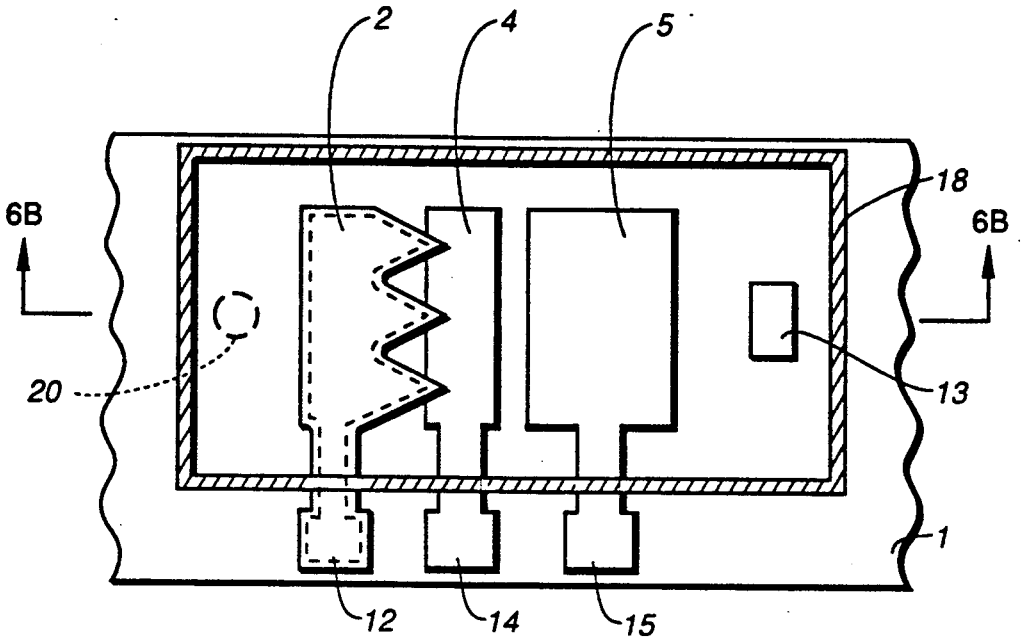
FIGS. 6(A)-(B) diagram a first embodiment of a planar triode microelectronic vacuum device.
Figure 6B:
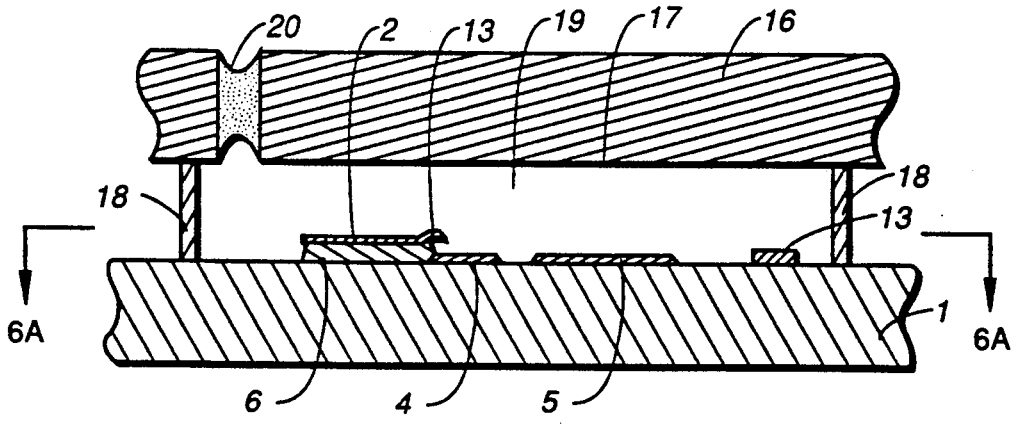

FIGS. 6(A) and 6(B) show a microelectronic vacuum triode comprising a first substrate 1, cathode 2 with electron emission tip 3, gate 4, anode 5, insulating layer 6, a second substrate 16 parallel to substrate 1 by virtue of enclosure 18, and a vacuum layer 19 contained between substrates 1 and 16 and that is walled-in by enclosure 18. Terminals 12, 14, and 15 are brought out to an edge of substrate 1 for external connections to the cathode, gate, and anode electrodes, respectively. A getter 13, comprising barium and aluminum ($BaAl_4$), is used to improve vacuum 19 by flashing getter 13 after the device is sealed. The gettering action is intended to consume any significant residual free gases. Substrate 16 comprises a quartz substrate one millimeter thick and has a conductive thin-film 17 used to bleed-off any static charge. A hole, filled by solder plug 20, is 700 micrometers in diameter, and is used in creating vacuum 19. Solder plug 20 comprises a gold-tin (Au-Sn) alloy. Enclosure 18 is a sintered frit glass made of a mixture of spherical glass spacers (fifty micrometers in diameter) that help to provide an air-tight seal of enclosure 18 to substrates 1 and 16. The thickness of the walls of enclosure 18 is about 500 micrometers. The space between substrates 1 and 16 is about 50 micrometers, and the vacuum 19 is preferably better than $1\times10^7$ Torr. An as yet unspent amount of gas gettering material 13 is added to complete the preparation of planar substrate 1 for sealing. A frit glass, made of a mixture of spherical glass spacers, is deposited by a screen printing method between enclosure 18 and the substrates 1 and 16. Both substrates are held together in position while the frit glass is sintered by heating to 450° C. and applying pressure. If necessary, pre-sintering of the frit glass can be done before joining. A thin-film of chrome (Cr) and gold (Au) are formed near the hole, and a small amount of an Au-Sn solder is put near the hole. The whole device is placed in a vacuum chamber, and a vacuum 19 forms inside the device via the hole in substrate 16. A laser beam is then focused to melt the Au-Sn solder, and the hole is thereby closed with plug 20. After being removed from the vacuum chamber, gas gettering material 13 is targeted by a laser that is focused from the back surface and getter 13 evaporates, taking in extraneous gases by a reaction that results in a solid precipitate (usually a silvery film inside the chamber). The lasers used for the above can be X-ma, YAG, or $CO_2$ lasers, among others.

In an exemplary design, about 200 planar diode electron devices can be fabricated on a single three inch wafer. Each device is, in this example, about four micrometers wide, 3.6 micrometers long and 2.1 micrometers thick. Other dimensions and wafer sizes are possible. A few of the various electric properties of the above devices have been empirically determined by the present inventor for an exemplary production lot, as above. Measurements of cathode current $I_k$, gate current $I_g$ and anode current $I_a$ were taken after grounding cathode electrode 2 and applying +200 volts ($V_{ak}=200$ V) to anode electrode 5 together with a control voltage ($V_{gk}$) on gate electrode 4. This typically yielded emission currents ($I_k$) of $3\times10^{-11}$ amps ($1\times10^{-11}$ A/piece) for $V_{gk}=60$ V, and $6\times10^{-8}$ amps ($2\times10^{-8}$ A/piece) for $V_{gk}=100$ V. This emission current results from a Fowler-Nordheim tunnel current. The anode current ratio ($I_a/I_k$) is about 0.90 at $V_{gk}=60$ V and drops to about 0.75 at $V_{gk}=100$ V. Compared with prior art technology, the minimum gate voltage required for cathode electron emission threshold voltage ($V_{kt}$) was reduced to less than half, and the anode current ratio ($I_a/I_k$), was observed to have improved over 20%, compared to the prior art. The variation of threshold voltages ($V_{kt}$) measured amongst devices that were diced from the same three inch wafer were also found to exhibit good device uniformity, as it did not exceed ±6%.

Although molybdenum is used for the thin films of the device electrodes above, it should be understood that other materials can also be successfully applied, such as tantalum (Ti), tungsten (W), silicon (Si), chrome (Cr), aluminum (Al), and even many alloys of these metals. Similarly, the insulated substrate can be substituted by silicon oxide ($SiO_2$), silicon nitride ($SiN_x$), alumina ($Al_2O_3$) and other ceramics, et cetera.

The threshold voltage ($V_{threshold}$) can be improved (reduced) further by coating the ends of the cathode tips of the cathode electrodes with materials having small work functions, e.g., barium, thorium, and cesium.

The electron emission noise of these devices can also be reduced by using multiple cathode tips for each cathode electrode, as above, such that the signal-to-noise (S/N) ratio is improved by the resulting simultaneous streams of electron emission.

A fluorescent substance can be added to the surface of anode electrode 5 of the device in FIG. 6 to create a luminous display. A fine X-ray source can also be realized by depositing a material that produces X-rays (e.g., a thin-film of copper) such that the cathode current can bombard it.

Figure 7:
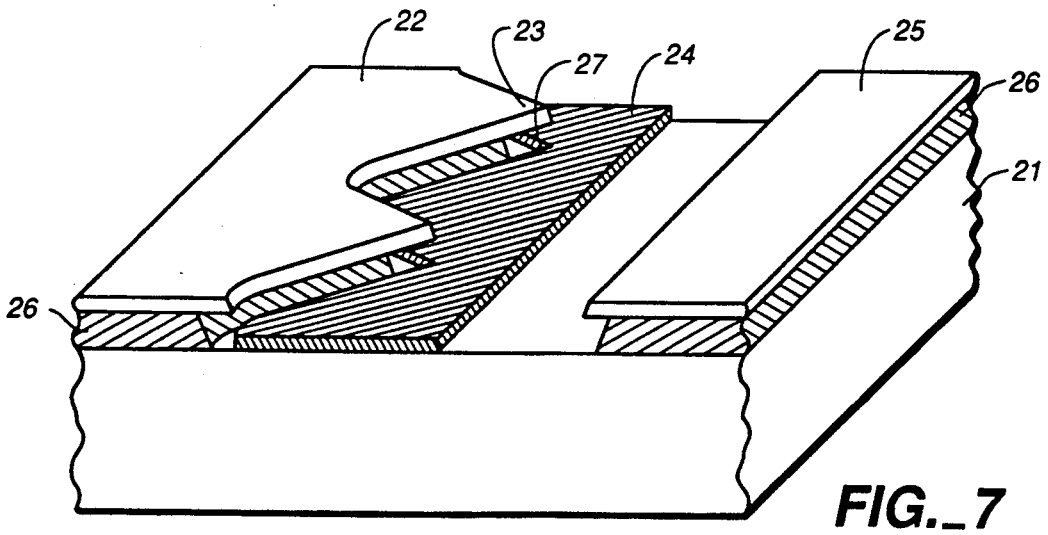
FIG. 7 is a partial three-dimensional view of a planar microelectronic vacuum device that has a gate electrode which was formed by self-aligning manner to the cathode electrode.

Second embodiment-FIG. 7 is a planar microelectronic vacuum device comprising cathode 22 with tips 23, gate 24, and anode 25. Gate electrode 24 is an aluminum thin-film that is deposited 1,000 Å thick on the surface of a planar quartz substrate 21. Cathode 22 and anode 25 each sit atop two independent, island-shaped insulators 26 which are made of thin-films of silicon dioxide about 5,000 Å thick. Cathode electrode 22 and anode electrode 25 comprise molybdenum thin-films 2,000 Å thick which overhang insulators 26. The three cathode tips 23 are repeated at a ten micrometer pitch. Cathode tips 23 are such that they project in the direction of gate electrode 24 and are parallel to planar substrate 21 (well clear of island insulator 26). The radii of curvature of tips 23 is about 500 Å. Gate electrode 24 has an edge 27 that parallels the nearby contours of tips 23 on the near edge of cathode 22. Edge 27 results from a process that self-aligns to the contours of cathode tips 23. The distance ($L_{gk}$) between gate electrode 24 and cathode tips 23 is determined by the thickness of island insulator 26 minus that of gate electrode 24. Anode and cathode electrodes 25 and 22 are both elevated from substrate 21 about 4,000 Å higher than gate electrode 24. Consequently, the distance from gate electrode 24 to a stream of electrons flowing from cathode tips 23 to anode 25 is also about 4,000 Å. The gap distance ($L_{ak}$) that the electron stream must traverse is about eight micrometers. Consequently, electrons arrive at anode electrode 25 without running a great risk of first colliding into gate electrode 24.

Figure 8A:
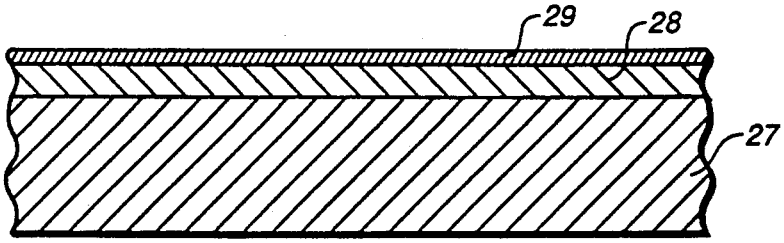
FIGS. 8(A)-(E) show cross-sectional views after each step of a second embodiment of a manufacturing process of the present invention.
Figure 8B:
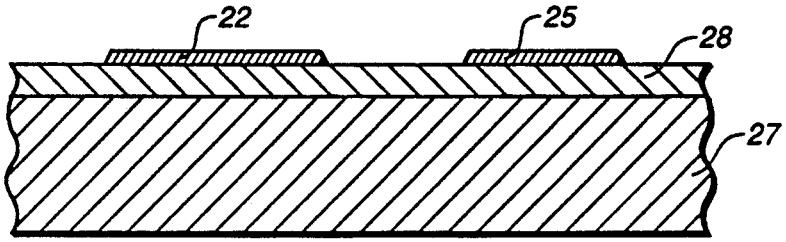
Figure 8C:
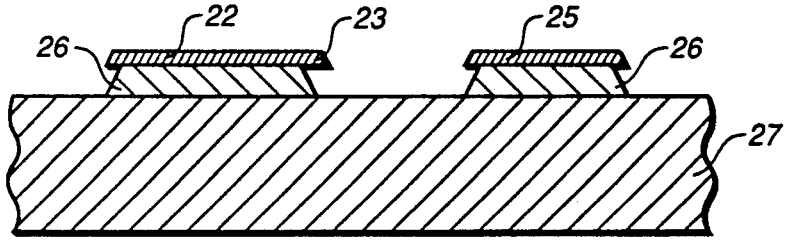
Figure 8D:
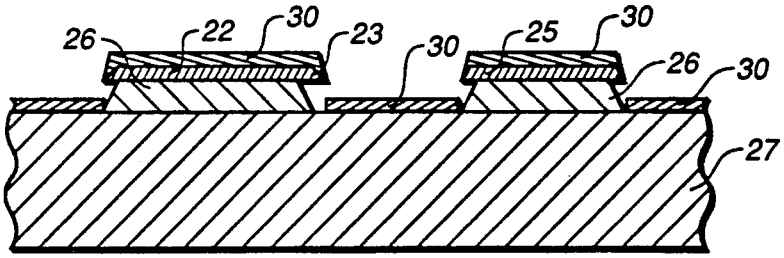
Figure 8E:
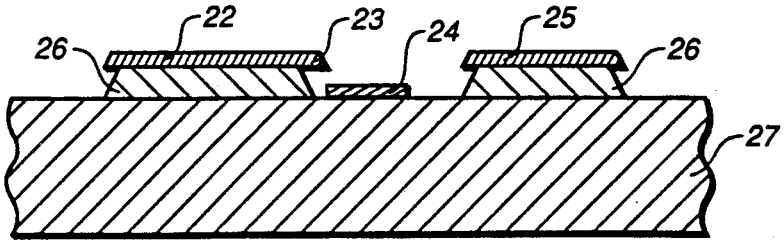

FIG. 8(A) shows a device having planar quartz substrate 21 having an insulation layer 28 and cathode-electrode layer 29 that have been deposited by sputtering. Layer 28 is a thin-film of silicon dioxide about 5,000 Å thick, and layer 29 is a thin-film of molybdenum about 2,000 Å thick. FIG. 8(B) shows that cathode electrode 22 and anode electrode 25 remain after dry etching cathode-electrode layer 29 (this is the same sort of etching of cathode-electrode layer 9, as is described above in first embodiment). In FIG. 8(C), all except for those parts protected by electrodes 22 and 25, the bulk of insulation layer 28 is etched away by a wet etch (which is the same as that described above in the first embodiment). Cathode tips 23 are exposed by the wet etching such that they cantilever out beyond insulator 26. Because substrate 21 is comprised of quartz, it is largely unaffected by the above etching. In FIG. 8(D), gate-electrode layer 30 has been formed by a self-aligned directional particle deposition method. An evaporation type of particle deposition is used to lay down a thin aluminum film about 1,000 Å thick. (The directional particle deposition method deposits particles that travel in straight lines from a power source onto the surface of planar substrate 21.) When such a method is used, electrodes 22 and 25 act as a sort of spray paint stencil that both shapes and positions gate-electrode layer 30 (this is commonly referred to as a self-aligned process). Acceptable directional particle deposition methods include various kinds of sputtering and electron cyclotron resonance (ECR) deposition. In FIG. 8(E), gate-electrode layer 30 has been trimmed by etching to form finished gate electrode 24. Conventional photo-etching with an hydrogen fluoride (HF) type etching solution is used to remove the aluminum deposited on top of electrodes 22 and 25. This kind of an etch will not erode the molybdenum in electrodes 22 and 25, but the self-aligned edge of gate electrode 24 (under cathode tips 23) must be covered with a photo-mask to protect the aluminum in gate electrode 24 from being inadvertently etched. Otherwise, the edge of gate electrode 24 would lose its contoured match with cathode tips 23, and overall device performance would be reduced.

Certain electrical properties of the above device under high vacuum have been measured with cathode electrode 22 being grounded and 200 V being applied to anode electrode 25 ($V_{ak}=200$ V). A cathode current ($I_k$) of $5\times10^{-11}$ amps was measured at a gate voltage ($V_{gk}$) of 60 V, and $1.4\times10^{-7}$ amps for when $V_{gk}=100$ V. Under such conditions, the efficiency, which is the ratio of anode current to cathode current ($I_a/I_k$), is about 92% for $V_{gk}=60$ V, and 80% for $V_{gk}=100$ V.

An advantage of this embodiment, compared to the first embodiment above, is that the distance ($L_{gk}$) between the cathode and gate can be smaller, as a direct result of the elevation of anode electrode 4.

Third embodiment

Figure 9A:
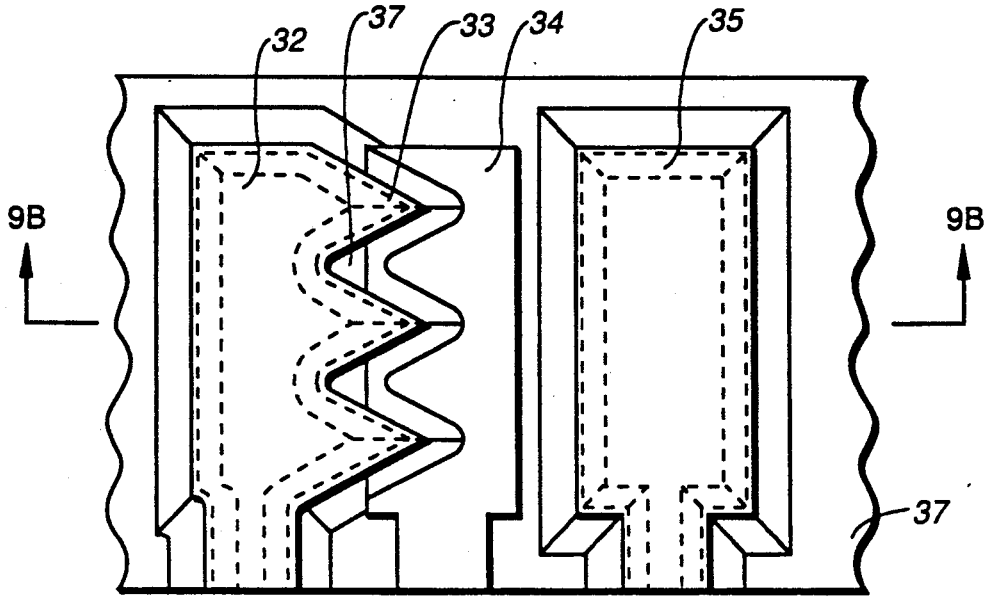
FIGS. 9(A)-(B) are diagrams of a planar microelectronic vacuum device in which the gate electrode is inclined.
Figure 9B:
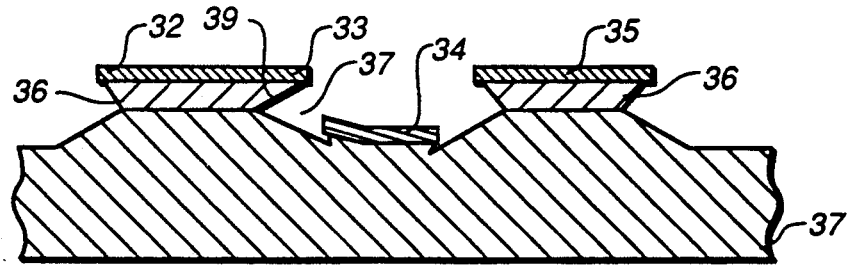

Referring now to FIGS. 9(A) and (B), a planar substrate 31 comprises Corning 7059 glass (or equivalent) about 1100 micrometers thick. Cathode electrode 32 and anode electrode 35 sit atop insulators 36 (resembling islands) which, in turn, are positioned on level areas of substrate 31. Gate electrode 34 spans both level areas and inclined areas (surface 37) between cathode and anode electrodes 32 and 35. Cathode electrode 32 has three cathode tips 33 on a pitch of ten micrometers. The tips of cathode tips 33 point to one side in the general direction of gate electrode 34 and are more-or-less parallel to the plane of substrate 31. The radii of curvature of cathode tips 33 is uniform at about 500 Å. Gate electrode 34 is nearly identical to its counterpart in the second embodiment above. Insulators 36 are silicon dioxide films about 3,000 Å thick. Cathode, gate, and anode electrodes 32, 34, and 35, respectively, each are comprised of thin molybdenum films roughly 2,000 Å thick. Near the cathode tips 33, the gate electrode 34 rises up about 25 degrees toward cathode 32. To do this, an inclined surface 37 is formed on substrate 31. Insulators 36 have sidewalls that cantilever out at an angle of about 23° from the plane of substrate 31 under cathode tips 33, and sidewalls that rise a quicker 45° elsewhere. The distance ($L_{gk}$) between cathode tips 33 and gate electrode 34 is about 4,000 Å. The distance ($L_{ag}$) between gate electrode 34 and anode electrode 35 is about three micrometers (30,000 Å), and the distance ($L_{ak}$) between cathode tips 33 and anode electrode 35 is about eight micrometers (80,000 Å). Electrons emitted from cathode tips 33 go over gate electrode 34 at about 5 micrometers, and the distance between the locus of the electrons and gate electrode 34 is 2.3 micrometers at maximum.

Figure 10A:
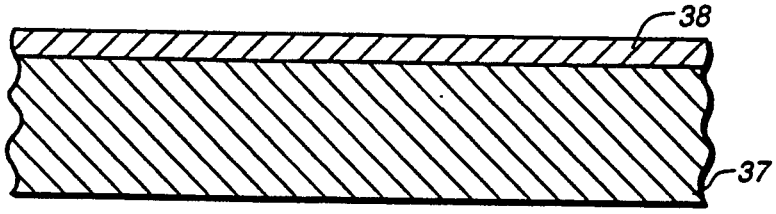
FIGS. 10(A)-(E) show cross-sectional views after each step of a third embodiment of a manufacturing process of the present invention.
Figure 10B:
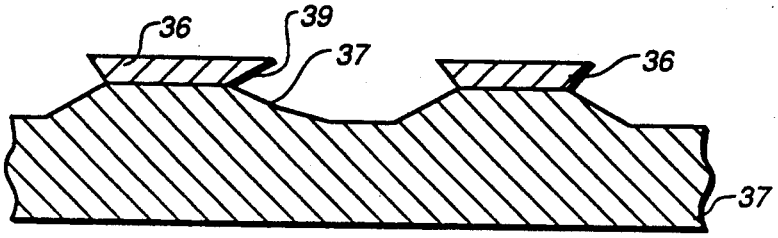
Figure 10C:
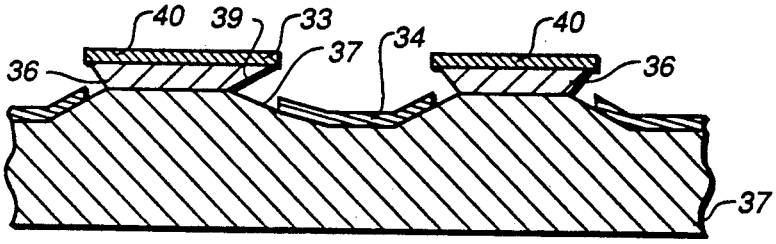
Figure 10D:
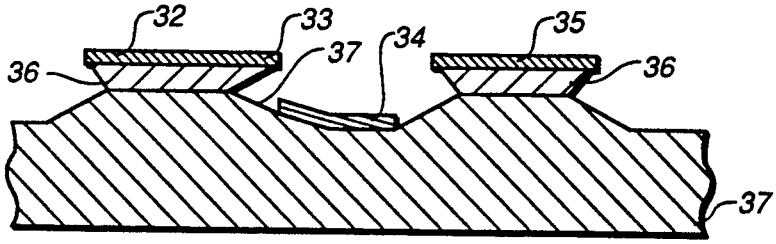
Figure 10E:
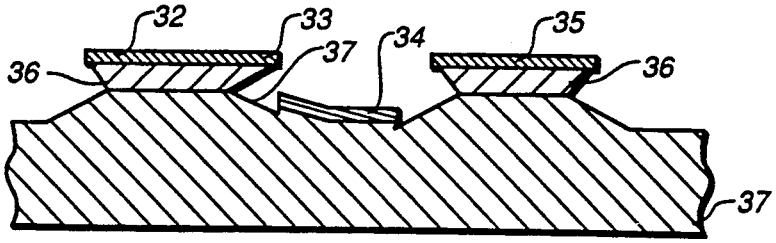
Figure 11A:
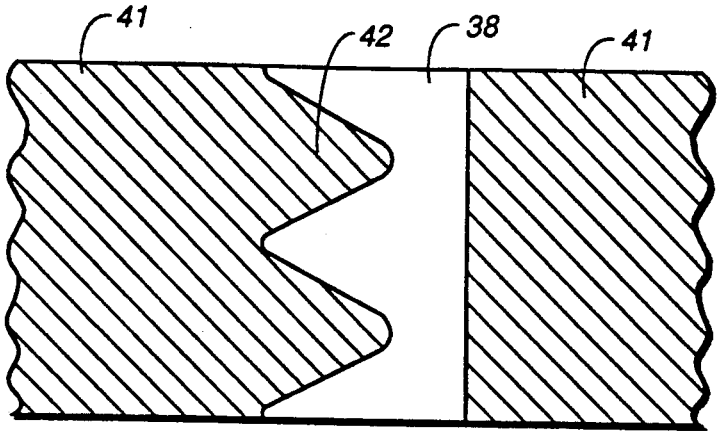
FIG. 11 shows the manufacturing process of etching the insulation layer and the planar substrate with an excess etching method.
Figure 11B:
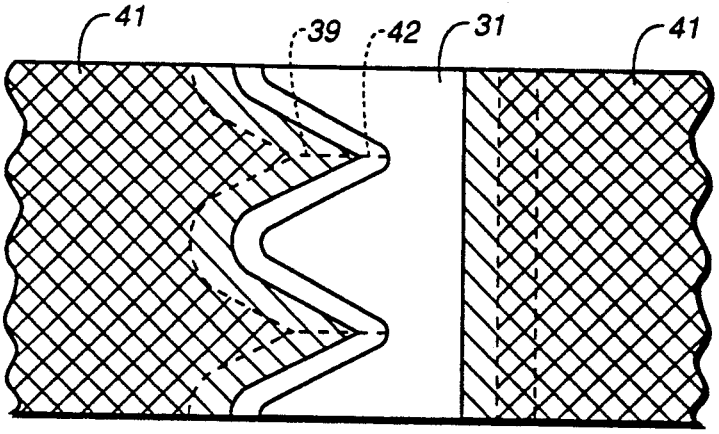
Figure 11C:
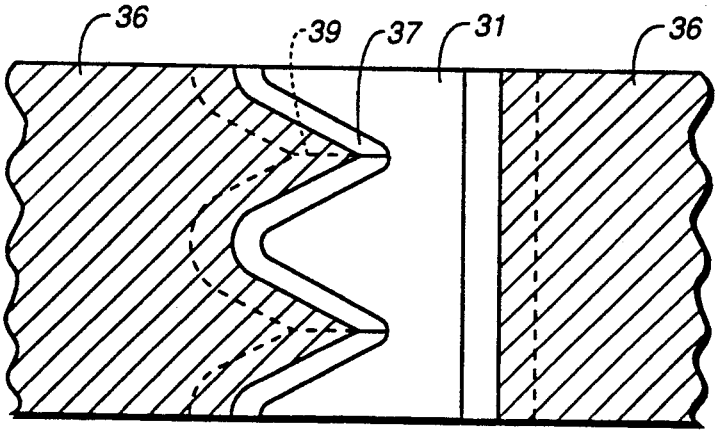

FIGS. 10(A)–(E) and 11(A)–(C) show the completion of various steps in a method of manufacturing the third embodiment described above. FIGS. 11(A)–(C) are top elevations that correspond to 10(A), and before and after FIG. 10(B), respectively. Note that, for clarity of this discussion only, photo-resist 41 and photoresist projections 42 only appear in FIGS. 11(A)–(C). FIG. 10(A) is a cross-sectional view of silicon dioxide insulation layer 38 after its having been deposited on substrate 31 about 3,000 Å thick by a conventional chemical vapor deposition (CVD) method. Preferably, the CVD deposition temperature is 300° C. with monosilane and oxygen gases at atmospheric pressure. After etching by an excess etching method (see above), the situation in FIG. 10(B) results. Parts of insulation layer 38 and substrate 31 have been removed such that insulators 36 are cut into islands from insulation layer 38 and have reverse tapered sidewalls that go down to join substate 31. A depression and an inclined surface 37 have been formed on substrate 31 between what will be the cathode and anode areas. In FIG. 10(C) a directional particle deposition method has been used to form a layer 40 of molybdenum film about 2,000 Å thick. (The manufacturing process is almost identical to the process described above for the second embodiment.) This process differs in that the parts of layer 40 that deposit on the surfaces of insulators 36 necessarily match the surfaces of insulators 36. FIG. 10(D) shows the after-effects of etching electrode layer 40 with a photo-etching method to form cathode electrode 32, gate electrode 34, and anode electrode 35. Dry etching of the molybdenum in these electrodes is described above. Cathode tips 33 having a radii of curvature of about 500 Å (laterally, as in FIGS. 11(A)–(C)) are formed on the upper surfaces of insulator cantilevers 39 as shown in FIG. 10(E). Supplemental etching of insulators 36 better exposes cathode tips 33. Substrate 31 is also etched a little in this last step. FIG. 11(A) shows photo-resist 41, having an interface reinforcing agent to improve adhesion with insulation layer 38, positioned to protect the anode and cathode electrode insulators 36. The thickness of photo-resist 41 is about one micrometer. Photo-resist projections 42 have a lateral radii of curvature of about 2,000 Å. Excess etching of insulation layer 38 in the lateral direction occurs over a distance that is several times the film thickness of insulation layer 38. The etching solution used is a mixture of hydrogen fluoride and acetic acid ($HF+CH_3COOH+H_2O$). The etching rates through silicon dioxide insulators 36 and glass substrate 31 are 1.38 and 0.8 micrometers per minute, respectively. The etching time is typically three minutes. After etching, FIG. 11(B) shows that the tips of insulation cantilevers 39 have been cut back about four micrometers from the edges of photo-resist projections 42. Because the etch attacks from both sides under projections 42, the lateral radii of curvature of cantilevers 39 is about 400 Å and this is improved over the original pointed shapes of photoresist projections 42. FIG. 11(C) is a view of after the removal of photo-resist 41, and corresponds to FIG. 10(B). Insulators 36 etch faster at their junction with substrate 31, and this is responsible for the reversetapered shape. As mentioned before, insulation layer projections 39 have sharper taper angles the other portions. Substrate 31 will etch typically no more than 2.2 micrometers, and the inside slope of cantilever 37 is about 25°.

In a test setup as described for the second embodiment, the third embodiment had $I_k=4.8\times10^{-11}$ amps at $V_{gk}=60$ V, and $I_k=2\times10^{-7}$ amps at $V_{gk}=100$ V. Anode current ($I_a$) was 95% of cathode current ($I_k$) at a gate voltage ($V_{gk}$) of 60 V and 85% at 100 V. These values, compared the second embodiment, show improved anode current yield and similar threshold voltages. The improved anode current yield results because the distance between gate electrode 34 and the locus of the electrons flowing from cathode electrode 32 to anode electrode 35 is farther than in the first two embodiments. This helps to avoid an electron flow to gate electrode 34. Because the distance $L_{gk}$ from the cathode to the gate is unchanged, the threshold voltage is about the same.

Fourth embodiment

Figure 12A:
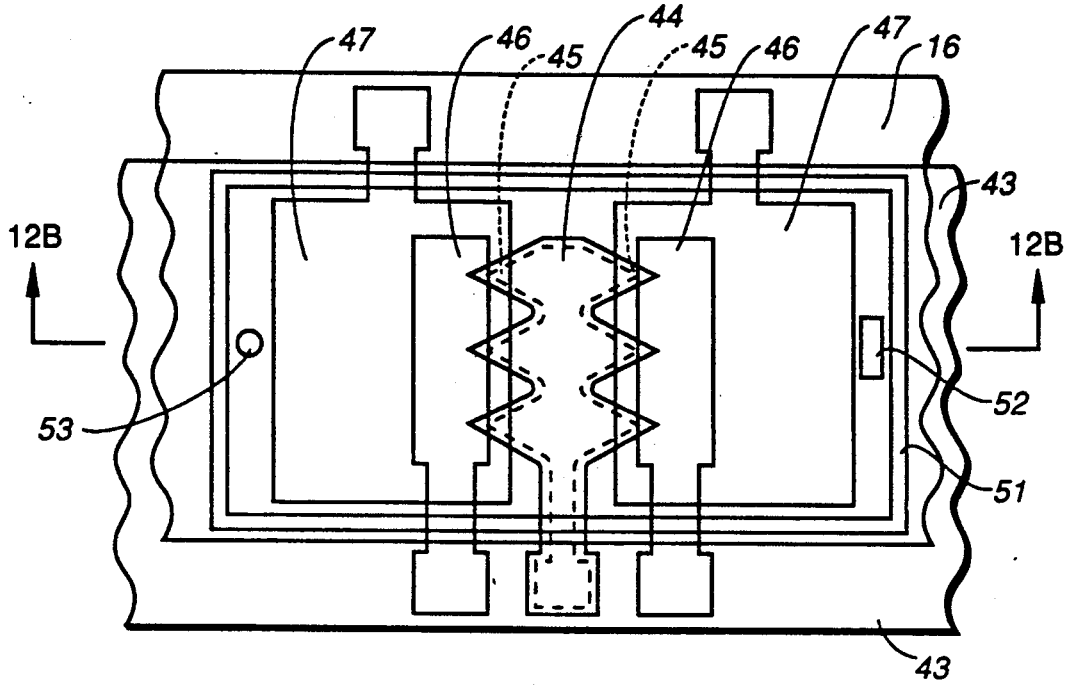
FIGS. 12(A)-(B) diagram a dual-type planar triode microelectronic vacuum device.
Figure 12B:
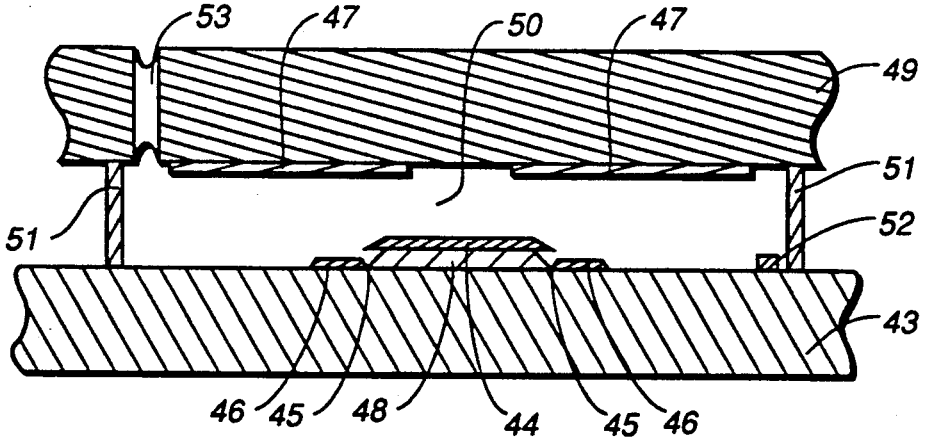

FIG. 12 illustrates a dual-triode planar microelectronic vacuum device comprising a dual-sided cathode electrode 44 and two gate electrodes 46. Two rows of cathode tips 45 face in opposite directions and produce two independent electron streams that are controlled by respective gate electrodes 46. Each stream of electrons flows to corresponding (and separate) anode electrodes 47, which are positioned on a second substrate 49. Thus, a pair of triodes having a common cathode is fashioned in a relatively small area. The same methods as in the first embodiment are used: in fabricating enclosure 51 between substrates 43 and 49, for closing-in vacuum 50 using plug 53, and in gettering the residual gases with getter 52.

Fifth embodiment

Figure 13A:
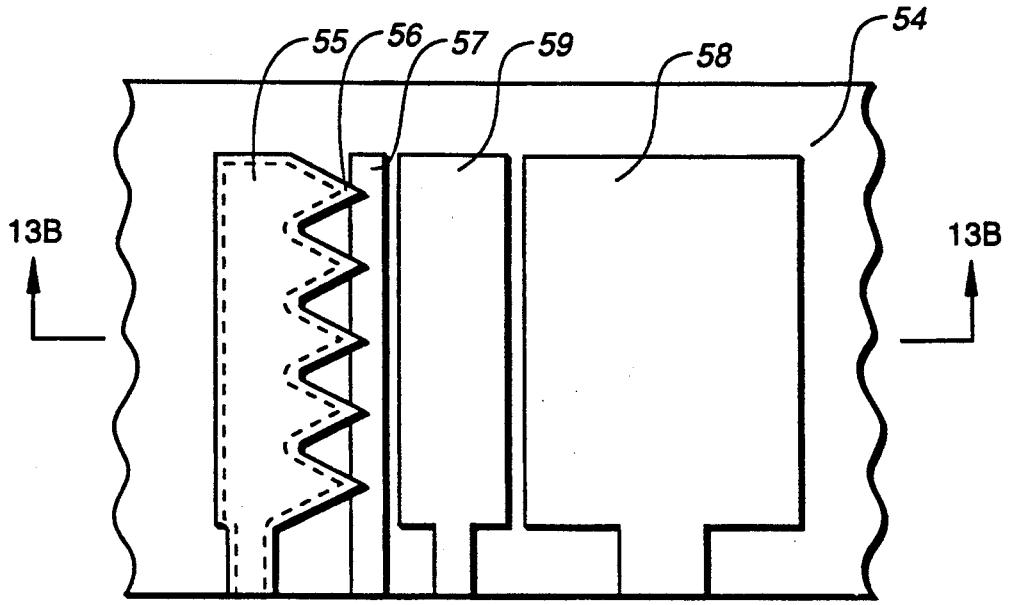
FIGS. 13(A)-(B) illustrate a planar tetrode microelectronic vacuum device.
Figure 13B:
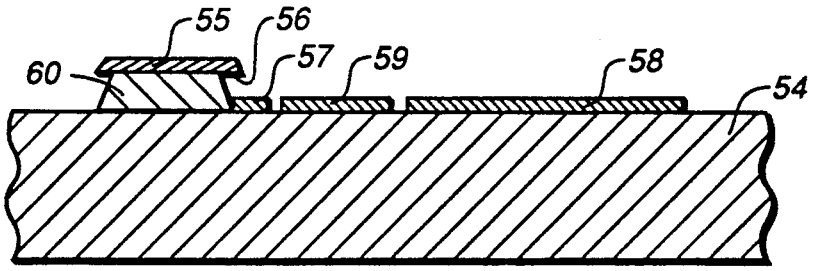

FIG. 13 diagrams a tetrode microelectronic vacuum device. Cathode and gate electrodes 55 and 57 are about the same as described above for second embodiment. A shield electrode 59 is positioned between gate electrode 57 and anode electrode 58. The shield electrode 59 is conceptually equivalent in its function to the second grid, or "screen" grid, in the ordinary tetrode vacuum tubes that were so common fifty years ago. One major difference, of course, is the instant tetrode embodiment, made according to the present invention, is orders of magnitude smaller in size. Shield electrode 59 acts to shield the field of anode electrode 58 as seen at cathode tips 56. In the triode described above as the first embodiment, the anode resistance is low, because the emission current from cathode tips 56 will vary depending on voltage on gate electrode 4 and the field of anode electrode 5. When a device is to be used in an amplifier or switch, a high anode resistance is required. By placing shield electrode 59 as shown and connecting it to ground, a very large anode resistance results. Since the actual anode resistance of the tetrode device will depend on the width of shield electrode 59, the width is chosen to optimize a trade-off that occurs between anode resistance and anode current yield. (The width of electrode 59 as used here means that distance across electrode 59 that electrons must travel on their way to the anode from the cathode.) Preferably, shield electrode 59 is about 50 micrometers wide and anode electrode 58 is 100 micrometers wide. Given these dimensions, tests made when shield electrode 59 was grounded 200 V was applied to the anode 58 ($V_{ak}$32 200 V), resulted in a cathode current ($I_k$) of $1.4\times10^{-7}$ amps for a gate voltage ($V_{gk}$) of 100 V. The anode resistance was measured to be 15 MΩ and the ratio of anode to cathode current ($I_a/I_k$) was 70%.

While the invention has been described in conjunction with several specific embodiments, it will be apparent to those skilled in the art that many other alternatives, modifications and variations are possible in light of the foregoing description. The invention described herein is therefore intended to embrace all such alternatives, modifications, applications and variations as may fall within the true spirit and scope of the appended claims.

What is claimed is:

1. A planar microelectronic vacuum tetrode, comprising:

an insulating substrate having a substantially flat surface;

an anode electrode deposited on a first part of the surface of the substrate;

a shield electrode deposited on a second part of the surface of the substrate, the shield electrode able to substantially raise the anode resistance of the tetrode;

a gate electrode deposited on a third part of the surface of the substrate;

a dielectric deposited on a fourth part of the surface of the substrate;

a cathode electrode deposited on the surface of the dielectric, the cathode electrode comprising at least one electron emission tip that cantilevers out beyond the dielectric and overlooks the gate electrode, said electron emission tip such that a flow of electrons can pass out and over the gate and shield electrodes on the way to the anode electrode, said cathode tip having a radii of curvature of less than 1,000 angstroms.

2. A microelectronic vacuum device, having at least one triode that comprises:

a planar insulating substrate having at least a portion of one surface maintained in a vacuum during operation of the triode;

an anode electrode deposited on a first part of said surface;

a gate electrode deposited on a second part of said surface and proximate to the anode electrode, the gate electrode able to control a flow of electrons in the vacuum to the anode electrode;

a dielectric deposited on a third part of said surface and overlapping a part of the gate electrode; and a cathode electrode deposited on the surface of the dielectric and having at least one cathode tip which cantilevers out beyond the dielectric and overlooks the gate electrode, said cathode tip having a sharpened end such that flow of electrons in the vacuum is promoted thereby.

3. A microelectronic vacuum device, having at least one triode that comprises:

first and second planar insulating substrates each respectively having at least a portion of one surface that is maintained in a vacuum common to both during the operation of the device;

means to maintain said vacuum;

an anode electrode deposited on a first part of said surface belonging to the first substrate;

a gate electrode deposited on a second part of said surface belonging to the first substrate and proximate to the anode electrode, the gate electrode able to control a flow of electrons in the vacuum to the anode electrode;

a dielectric deposited on a third part of said surface belonging to the first substrate and overlapping a part of the gate electrode;

a cathode electrode deposited on the surface of the dielectric such that at least one cathode tip cantilevers out beyond the dielectric and overlooks the gate electrode, said cathode tip having a sharpened end such that flow of electrons is promoted thereby and such that the flow of electrons can pass directly over the gate electrode in a straight-line path to the anode electrode.

4. The device of claim 3, further comprising:

means to getter gas from said vacuum after a sealing of the means to maintain said vacuum.

5. A microelectronic vacuum device, having at least one triode that comprises:

a planar insulating substrate with at least a portion of a substrate surface maintained in a vacuum during operation of the triode;

a first dielectric deposited on a first part of said substrate surface;

an anode electrode deposited on the surface of the first dielectric such that the anode electrode is elevated from the substrate;

a gate electrode deposited on a second part of said substrate surface and proximate to the anode electrode, the gate electrode able to control a flow of electrons in said vacuum that flow to the anode electrode;

a second dielectric deposited on a third part of said substrate surface; and a cathode electrode deposited on the surface of the second dielectric such that the cathode electrode is elevated from the substrate and such that the flow of electrons from the cathode tips can pass directly over the gate electrode in a straight-line path to the anode electrode, the cathode electrode having at least one cathode tip which cantilevers out beyond the second dielectric and which overlooks the gate electrode, said cathode tip having a sharpened end that promotes said electron emission.

6. A microelectronic vacuum device, having at least one triode that comprises:

an insulating substrate with at least a portion of one of its surfaces maintained in a vacuum during operation of the triode;

a first dielectric deposited on a first part of said substrate surface;

an anode electrode deposited on the surface of the first dielectric such that the anode electrode is elevated from the substrate;

a depression of said substrate surface, the depression having a floor and at least one incline, a gate electrode deposited on a part of said floor and incline within the depression, the gate electrode able to control a flow of electrons through said vacuum to the anode electrode;

a second dielectric deposited on a second part of said substrate surface such that the depression is between the first and second parts of said substrate surface; and a cathode electrode deposited on the surface of the second dielectric such that the cathode electrode is elevated from the substrate so that the flow of electrons from the cathode tips can pass directly over the gate electrode in a straight-line path to the anode electrode, the cathode electrode having at least one cathode tip that cantilevers out beyond the second dielectric and overlooks the gate electrode, said cathode tip having a sharpened end that promotes said electron emission.

7. The device of claim 2, 3, 4, 5, or 6, wherein:

the gate electrode has an edge complementary in shape to an adjacent edge of the cathode electrode and its tips.

8. The device of claim 2, 3, 4, 5, or 6, wherein:

the cathode electrode has at least three cathode tips spaced at approximately a 20 micrometers pitch.

9. The device of claim 2, 3, 4, 5, or 6, wherein:

the cathode tips have a radii of curvature of about 800 Å.

10. The device of claim 2, 3, 4, 5, or 6, wherein:

the gate electrode and cathode tips are separated by a distance of approximately 5,000 Å;

the gate electrode and anode electrode are separated by a distance of approximately five micrometers; and the distance between cathode tips and anode electrode is approximately twelve micrometers.

11. The device of claim 2, 3, 4, 5, or 6, wherein:

the electrons emitted from cathode tips have a clear path through a vacuum to the anode electrode such that substantially all the electrons leaving the cathode electrode can be collected by the anode electrode.

12. A planar microelectronic field emission device, comprising:

a) a non-planar insulating substrate said substrate having level raised plateau regions and depressed valley regions;

b) a first insulating island disposed on a first plateau region of said substrate, and a laterally opposed, second insulating island disposed on a second plateau region of said substrate;

c) a cathode electrode disposed on said first insulating island and having cathode tips that are substantially parallel to said level plateau regions and cantilever out beyond an edge of said first plateau region;

d) an anode electrode disposed on said second insulating island, said anode electrode being substantially co-planar with said cathode electrode; and f) a gate electrode disposed on said valley region of said substrate, said gate electrode having a portion which is inclined upwardly toward said cathode electrode such that said gate electrode is operable to control an electron emission from said cathode tips .

13. The device of claim 12, wherein said substrate comprises Corning 7059 glass.

14. The device of claim 12, wherein said cathode, said gate and said anode each comprise molybdenum.

15. The device of claim 12, wherein said insulators comprise an oxide of silicon.

* * * * *